US005608927A

United States Patent [19]

Lowry et al.

[11] Patent Number: 5,608,927

[45] Date of Patent: Mar. 11, 1997

[54] RECIRCULATING BATHING FIXTURE

[75] Inventors: Scott R. Lowry, Hamilton, Ohio; Thomas A. Bonnell; Robert C. Giese, both of Sheboygan, Wis.

[73] Assignee: Kohler Co., Kohler, Wis.

[21] Appl. No.: 593,290

[22] Filed: Jan. 29, 1996

Related U.S. Application Data

[63] Continuation of Ser. No. 371,059, Jan. 10, 1995, abandoned, which is a continuation of Ser. No. 91,490, Jul. 14, 1993, abandoned.

[51] Int. Cl.[6] ..... A47K 3/22

[52] U.S. Cl. ..... 4/615; 4/678; 4/603; 4/596; 4/507; 239/193

[56] References Cited

U.S. PATENT DOCUMENTS

| | | | |
|---|---|---|---|
| D. 8,731 | 10/1874 | Tweeddale | D23/201 |
| D. 15,637 | 12/1884 | Moore | D23/201 |
| 1,572,275 | 2/1926 | Ewing . | |
| 1,928,799 | 10/1993 | Stevens | D23/201 |
| 3,121,235 | 2/1964 | Gellmann | 4/148 |
| 4,099,272 | 7/1978 | Sowder | 4/148 |
| 4,224,700 | 9/1980 | Bloys | 4/603 |
| 4,274,400 | 6/1981 | Baus | 128/53 |
| 4,334,328 | 6/1982 | Delepine | 4/191 |
| 4,346,484 | 8/1982 | Martin | 4/492 |
| 4,513,458 | 4/1985 | Delepine | 4/661 |
| 4,724,553 | 2/1988 | Bianchi | 4/615 |
| 4,796,312 | 1/1989 | Corlew | 4/555 |
| 4,823,409 | 4/1989 | Gaffney et al. | 4/192 |
| 4,881,280 | 11/1989 | Lesikar | 4/507 |
| 4,912,782 | 4/1990 | Robbins | 4/678 |
| 4,926,510 | 5/1990 | Watkins | 4/541.6 |
| 4,964,399 | 10/1990 | Faimali | 128/66 |
| 5,060,322 | 10/1991 | Delepine | 4/601 |
| 5,073,996 | 12/1991 | Schinle | 4/601 |
| 5,115,974 | 5/1992 | Tobias et al. | 4/492 |
| 5,127,111 | 7/1992 | Sieth | 4/591 |
| 5,167,368 | 12/1992 | Nash | D23/201 |
| 5,197,459 | 3/1993 | Henkin et al. | 4/541.6 |
| 5,249,744 | 10/1993 | Ruthenberg | 239/193 |
| 5,293,654 | 3/1994 | Castwall et al. | 4/598 |

FOREIGN PATENT DOCUMENTS

| | | | |
|---|---|---|---|
| 0178453 | 4/1986 | European Pat. Off. . | |
| 275084 | 7/1988 | European Pat. Off. . | |
| 2469212 | 5/1981 | France | 4/661 |
| 5154426 | 6/1993 | Japan | 239/193 |

OTHER PUBLICATIONS

Page 10–3a of a Kohler Co. K–500 catalog dated Aug. 1991 showing the Whitecap Shower/Foot Bath Whirlpool.

An Itema advertisement, undated.

Page 88 of a 1991 Bains magazine entitled "Jets toniques et douche–plaisir" with a partial translation.

The cover and next page of a "New Products" 1992 brochure of the Kohler Co. showing the Mastershower tower.

Page 10 of a 1989 Kohler Co. brochure illustrating the "Tea–for–Two" Whirlpool Bath.

Page 2–4 of a Kohler Co. K–500 catalog illustrating the "Pillows" flume spout.

A cover page of a 1992 Jacuzzi Owner's Manual.

Page 7 of a Dec. 1991 Jacuzzi ad.

2 pages of a News Release describing the "J–Dream Whirlpool Bath".

Page 89 of a 1991 Bains magazine showing three shower units.

*Primary Examiner*—Henry J. Recla
*Assistant Examiner*—Gregory M. Vidovich
*Attorney, Agent, or Firm*—Quarles & Brady

[57] ABSTRACT

A spout which can effect a waterfall in the form of a sheet of water in conjunction with the recirculation of bathing water is described. An accumulator with a baffle structure receives the recirculating bathing water to place it in a quiescent state before passage from the spout. In a preferred embodiment, there is a whirlpool basin which receives bathing water from the spout as well as body spray nozzles which also receive recirculating water from the basin.

9 Claims, 3 Drawing Sheets

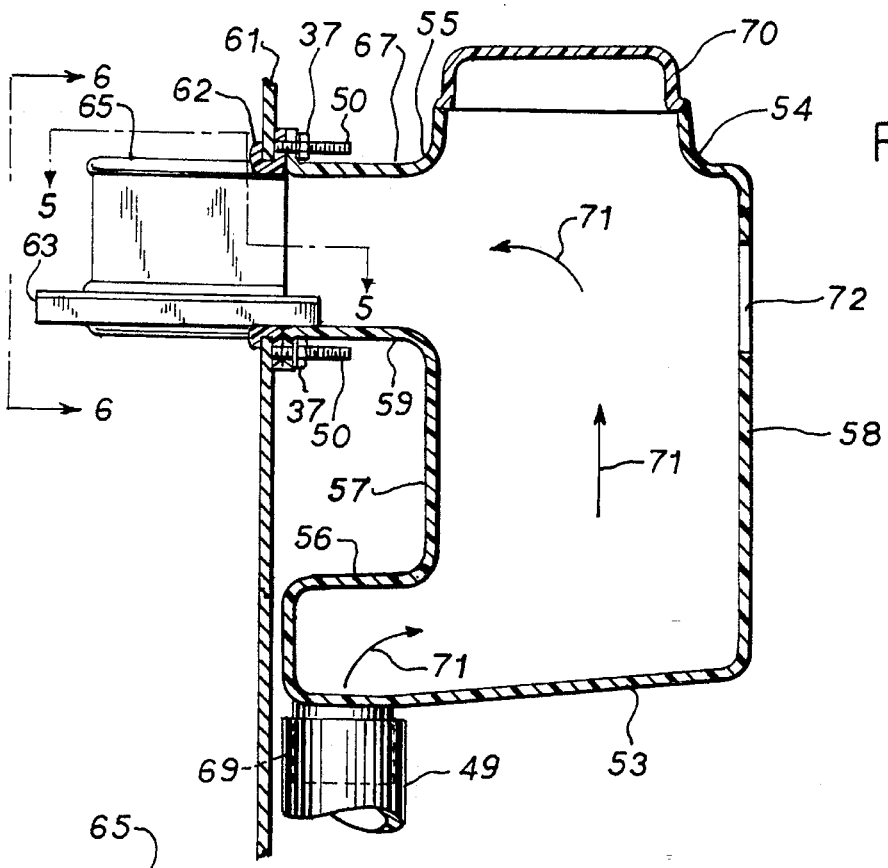
FIG. 4
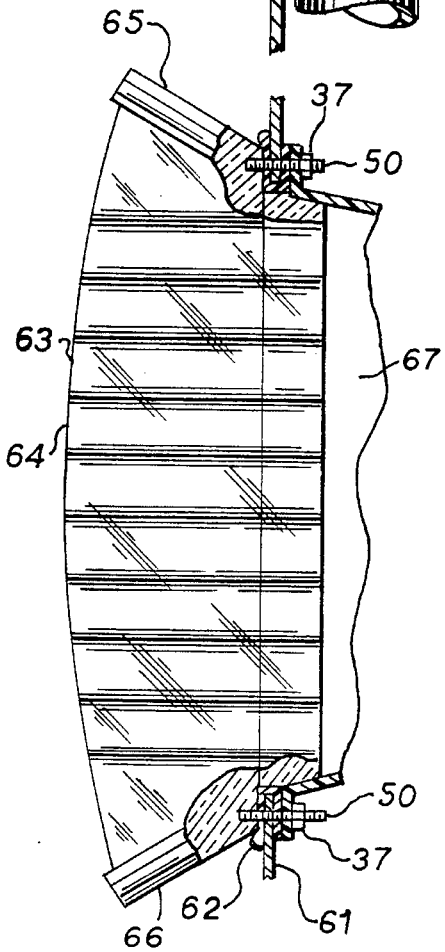
FIG. 5
FIG. 6
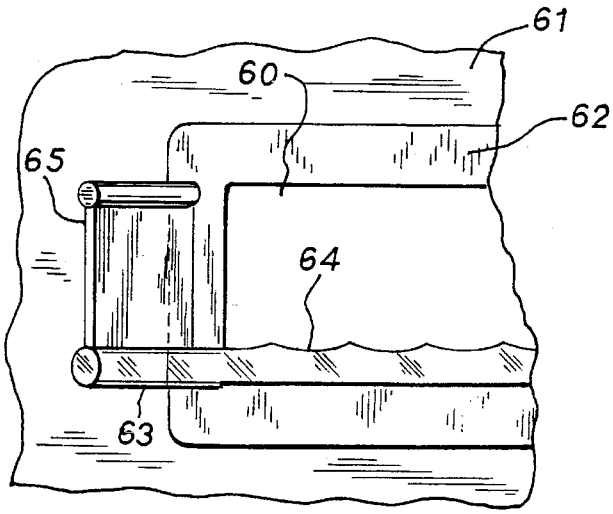

RECIRCULATING BATHING FIXTURE

This is a continuation of application Ser. No. 08/371,059 filed Jan. 10, 1995 which is a continuation of application Ser. No. 08/091,490 filed Jul. 14, 1993, both, of which are abandoned.

BACKGROUND OF THE INVENTION

1. Field of the Invention

The field of the invention is bathing fixtures, and more particularly, fixtures which employ recirculation of the bathing water to an elevated spout.

2. Description of the Art

Showers which combine a foot whirlpool in conjunction with an overhead shower nozzle and a seat are known. Such a unit is available from the Kohler Co. as the Whitecap shower and foot bath whirlpool. There is also known in the prior art a bathing fixture wherein the bathing water is recirculated to an overhead shower. This is described in U.S. Pat. No. 4,724,553 where bathing water is recirculated to rotating nozzle structures.

"Sheet flow" spouts, where water cascades in a waterfall rather than spray fashion, have also been used in bathing areas. Such a bathing fixture is also available from Kohler Co. as the Mastershower tower. However, this system uses line pressure water as its water supply source.

The prior art does not provide a bathing fixture wherein the bathing water is recirculated to a sheet flow spout so as to afford a sheet-like cascading waterfall. A difficult problem is presented in designing such a system is that pumped recirculating water is of unsteady pressure, and this does not readily lend itself to use in a spout that forms a sheet of water (as distinguished from sprays through multiple holes).

SUMMARY OF THE INVENTION

In one aspect the invention provides a bathing fixture wherein water is recirculated to a spout which includes a lower basin for collecting water and a waterfall spout having an outlet mounted above the basin. A pump is provided for recirculating water that has collected in the basin to the spout, whereby the spout can deliver a sheet of water through the outlet.

In one preferred form, the pump can be directed to pump water to a whirlpool outlet in a basin side wall. The basin is part of a foot bath. This could be an alternative flow path, or if desired, both functions could be operating simultaneously.

In another preferred form, the bathing fixture includes an accumulator cavity positioned between the pump and outlet of the spout for collecting water delivered from the pump and dampening water pressure differences at the outlet.

In another aspect, there is a waterfall spout for supplying a sheet of water. The spout has an inlet and a outlet in the form of a slot. There is an accumulator between the outlet and inlet having greater cross sectional area than either. The accumulator has a baffle system for causing water to change (preferably completely reverse) direction at least once when traveling from the inlet to the outlet so as to thereby collect water and dampen water pressure differences at the outlet. The outlet has a ledge extending generally horizontally at the spout outlet. In a preferred form, the ledge has an undulating upper surface.

In yet another preferred form, there are a plurality of body spray nozzle members disposed in a vertical manner between the basin and the receptacle member.

The objects of the invention therefore include:

a. providing a waterfall spout of the above kind which provides a cascading waterfall while using recirculated water;

b. providing a foot bathing fixture of the above kind wherein bathing water is recirculated to either a foot bathing fixture, a body spray nozzle, or a waterfall spout simultaneously or individually; and c. providing a foot bathing fixture of the above kind wherein recirculated water is brought to a relatively steady state prior to its flowing from the waterfall spout.

The foregoing and other objects and advantages of the invention will appear from the following description. In the description, reference is made to the accompanying drawings which form a part hereof, and in which there is shown by way of illustration preferred embodiments of the invention. Such embodiments do not necessarily represent the full scope of the invention. Therefore, reference is made to the claims herein for interpreting the scope of the invention.

BRIEF DESCRIPTION OF THE DRAWINGS

FIG. 4 is an enlarged view, in vertical section, showing the waterfall spout feature of the invention;

FIG. 5 is a sectional view taken along line 5—5 of FIG. 4;

FIG. 6 is a partial elevational view taken along line 6—6 of FIG. 4.

DESCRIPTION OF THE PREFERRED EMBODIMENT

Figure 1:
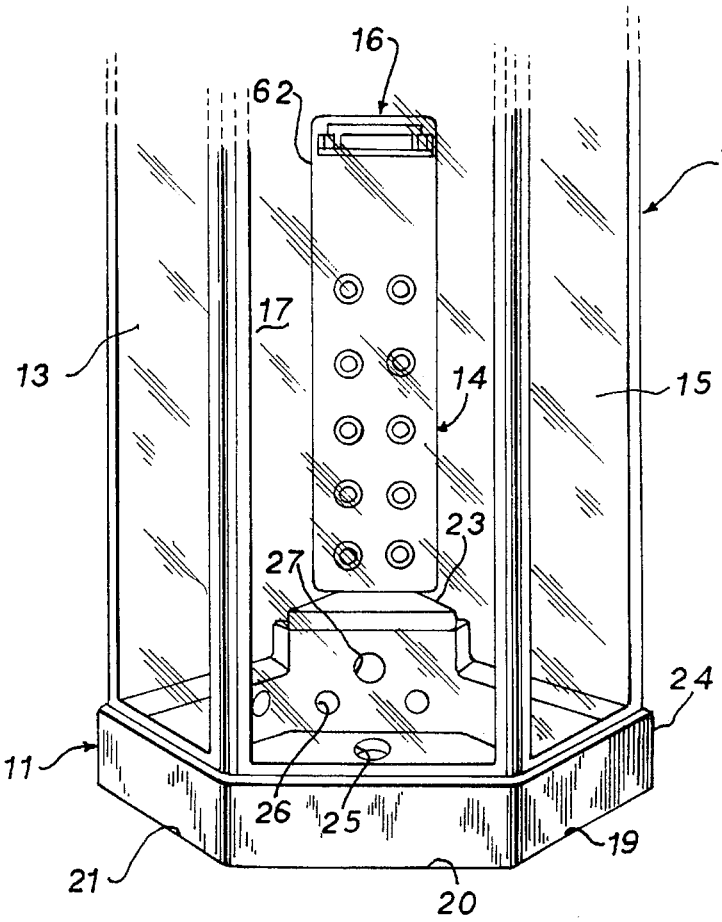
FIG. 1 is a front perspective view showing the bathing fixture constituting a preferred embodiment of the invention.
Figure 7:
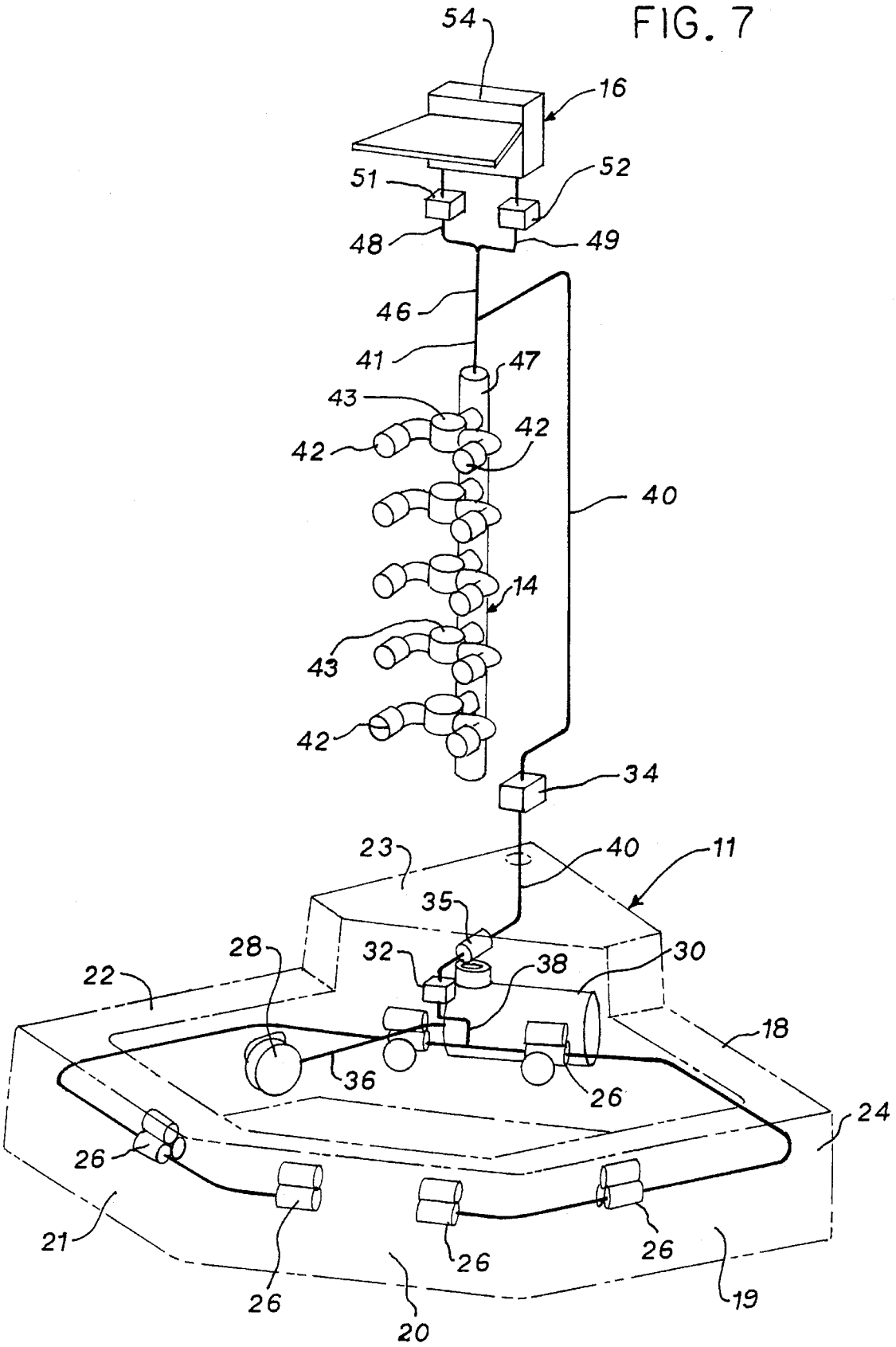
FIG. 7 is a diagrammatic view showing the water recirculation pathways.

Referring particularly to FIGS. 1 and 7, the bathing fixture (generally 10) includes a basin 11, a jet nozzle assembly 14 and a waterfall spout 16. The basin 11 is essentially disclosed in U.S. Pat. No. 5,224,224 and is commonly assigned. Its teachings are herein incorporated by reference.

The basin is of the foot bath whirlpool type, and includes side walls 18, 19, 20, 21 and 22. There is also provided a seat 23 and drain 25 which under normal operating conditions is closed. An enclosure is effected by the side panels 13 and 15 and a door panel 17 (and the bathroom side walls). There are whirlpool jet outlets 26 in the basin as well as an overflow drain 27. As best seen in FIG. 7, an inlet 28 to the recirculation system is connected by the line 36 to the pump 30, which feeds bathing water to the jets 26 by means of the "T" connector 35, valve 32 and outlet line 38. A variable flow valve 34 controls the flow of water to the waterfall spout 16, as well as the body spray nozzle assembly 14 by means of line 40. Water will be initially introduced to the basin 11 such as by a standard bath spout (not shown).

Figure 2:
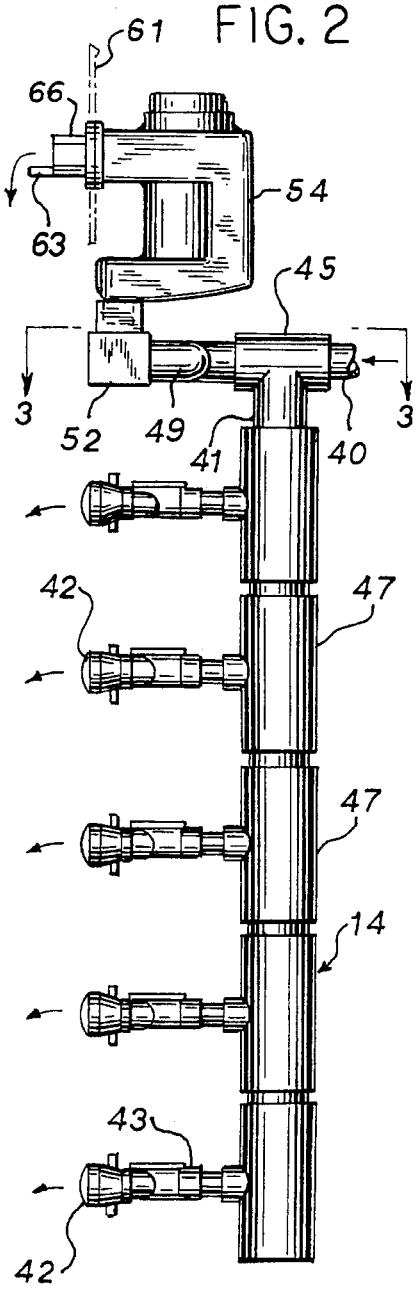
FIG. 2 is an enlarged partial side view showing the body spray nozzles and waterfall spout feature.

A jet nozzle assembly 14 receives water from line 41 which is connected to a series of valve bodies 47. This is seen in FIG. 2. It includes five sets of nozzles 42 each individually controlled by a valve 43 so that water can be sprayed from the nozzles 42 at different heights if desired.

In a preferred manner, the seat 23 maybe slidable in and out so that the bather can experience the effects of the waterfall spout 16, the jet nozzle assembly 14 or the whirlpool jet outlets 26 when seated with the seat extended. The seat would be retracted so the bather can effect the same purpose while standing.

Figure 3:
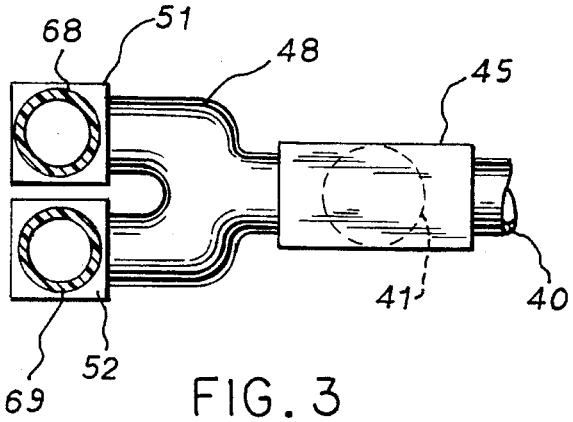
FIG. 3 is a view taken along line 3—3 of FIG. 2.

With reference to the spout 16, line 46 conveys water to branch lines 48 and 49 through valves 51 and 52 and to the water accumulator 54 of spout 16. As shown in FIGS. 2 and 3, water from line 40 is fed through a "T" connection 45 to the two branch lines 48 and 49 to introduce water through two separate inlets 68 and 69 into the accumulator 54.

Referring to FIG. 4, accumulator 54 has a horizontal baffle wall 56 opposite the inlet 69 in order to redirect the flow of bathing water in the accumulator 54 at a right angle so that it cannot flow directly to the outlet passage 67. Accordingly, water changes direction and flows in the direction of the flow arrows 71 and between the vertical walls 57 and 58. It flows outwardly over horizontal wall 59 and under horizontal wall 55 forming the outlet passage 67. An opening 60 is provided in outlet passage 67, and water flows freely over a ledge member 63 extending from opening 60.

Ledge member 63 is partially supported by the outlet passage 67 as well as by the opposing diverging guide members 65 and 66. This is seen in FIGS. 5 and 6. These guide members not only support the ledge 63 but provide a barrier for the water from flowing laterally off of the ledge 63. Guide members 65 and 66 are secured to the ledge member 63 and the accumulator 54 such as by adhesively adhering the guide members 65 and 66 to the sides of the ledge member 63 and connecting the guide members 65 and 66 to the accumulator 54 such as by studs 50 and nuts 37 passing through frame 62. Frame 62 is also connected to the accumulator by the studs 50 and nuts 37.

As seen in FIGS. 5 and 6, the ledge member 63 has an undulating surface 64 for the purpose of effecting a smooth and uniform water flow at low flow rates. The undulations direct the water in a generally parallel manner along the axis of water flow at the low flow rates to provide a sheet flow. This is an important feature in permitting the accumulator system to be used at normal pump speeds.

As seen in FIGS. 4 and 5, a panel member 61 is connected to the accumulator such as by the framework 62. There is an opening 72 in the back wall 58 so that a light can be provided to illuminate the water therein for an aesthetic effect. A removable top 70 provides access to the inside of the accumulator so as to affix and service a light provided therein.

An important feature of the recirculating whirlpool and the waterfall spout is the fact that it can recirculate bathing water and yet afford a well formed waterfall "sheet" at the top of the unit. This is accomplished in part by means of the accumulator 54 and the wall structure so that indirect water flow is effected from a pump. This indirect flow path, plus the fact that the accumulator has a substantially larger volume or greater cross sectional area than either the outlet passage 67 or inlets 68 and 69 gives a quiescent state to the water. This quiescent state in conjunction with the ledge member 63, provides in effect a gravitational or cascading waterfall similar to the flow of water over a dam. Importantly, the water sheet stays together for a significant distance after leaving the spout edge.

It will be appreciated that not only can the water be recirculated to the waterfall spout 16, but also to the body spray nozzle assembly 14 as well as the whirlpool jet outlets 26 in the basin 24. These can either be alternative flow paths, or if desired simultaneous flows. As indicated previously, the flow of water can be controlled separately to the jet outlets 26 such as by the valve 32 and to the jet nozzle assembly 14 and the waterfall spout 16 by the variable flow valve 34. In addition, individual body spray nozzles are controlled by the valves 43 and the flow of water to the waterfall additionally controlled by the valves 51 and 52.

Thus the invention provides an improved bathing fixture. While the waterfall feature and spout 16 has been shown in conjunction with a whirlpool bathing fixture and the jet nozzle assembly 14, it should be appreciated that the waterfall effect, is under normal conditions, utilized separately and without them. However, as indicated above, they could operate together in any combination. Accordingly, it would not be necessary to have the variable controls such as valves 32 and 34 although this provides for a more versatile operation. While two valves 51 and 52 have been shown in conjunction with controlling the water flow to the accumulator 54, only one valve is required in conjunction with a single line rather than the two lines 48 and 49 as shown.

We claim:

1. A bathing fixture wherein water is recirculated to a spout, comprising:

a lower basin for collecting water, said basin including a basin wall;

a conduit connected to and extending from the lower basin;

a waterfall spout in fluid communication with the lower basin via the conduit, said spout having an inlet operatively connected to said conduit and an outlet mounted above the basin, said outlet including an upwardly open ledge member with a contoured undulating upper surface for directing water in a generally parallel manner from said outlet, the undulating upper surface positioned at a front edge of the ledge member and extending from the front edge toward a rear thereof and essentially in a horizontal manner to direct the water in an essentially horizontal manner with respect to the lower basin and said spout and in the form of a continuous sheet of water;

a pump forming a part of the conduit for recirculating water that has collected in the basin to the spout;

an accumulator including a cavity positioned at an inlet of the spout, said pump also being connected to the spout via the conduit and the accumulator cavity being constructed and arranged to effect an essentially uniform rate of water flow out the spout during operation of said pump, the spout being upwardly open over a majority of the ledge portion of said undulating upper surface; and a plurality of wager outlet spray nozzles operatively connected to said conduit, said outlet nozzles positioned with respect to each other in an essentially vertical manner between the basin and the spout outlet and above the basin wall.

2. The bathing fixture as defined in claim 1, wherein the accumulator includes baffle means which causes the water in it to reverse direction at least once before exiting the spout outlet.

3. The bathing fixture as defined in claim 1, wherein the conduit is connected to an underside of the accumulator cavity and there is a baffle structure in the accumulator cavity interrupting inlet water flow to the accumulator cavity in the form of a horizontal baffle member.

4. The bathing fixture as defined in claim 1, wherein the pump is connected to a whirlpool outlet in a basin side wall of said basin and is directed to pump water to the whirlpool outlet.

5. The bathing fixture as defined in claim 4 wherein the basin is a foot bath.

6. A bathing fixture wherein water is recirculated to a spout, comprising:

a lower basin for collecting water, said basin including a basin wall;

a conduit connected to and extending from the lower basin;

a waterfall spout in fluid communication with the lower basin via the conduit, said spout having an inlet operatively connected to said conduit and an outlet mounted above the basin, said outlet including an upwardly open ledge member with a contoured undulating upper surface extending essentially in a horizontal manner from a front edge to a rear thereof to direct the water in an essentially horizontal manner with respect to the lower basin and said spout and in the form of a sheet of water;

a pump forming a part of the conduit for recirculating water that has collected in the basin to the spout;

an accumulator including a cavity positioned at an inlet of the spout, said pump also being connected to the spout via the conduit and the accumulator cavity being constructed and arranged to effect an essentially uniform rate of water flow out the spout during operation of said pump, the spout being upwardly open over a majority of the ledge portion of said undulating upper surface; and a plurality of water outlet spray nozzles operatively connected to said conduit, said outlet nozzles positioned with respect to each other in an essentially vertical manner between the basin and the spout outlet and above the basin wall;

whereby the spout can deliver a sheet of water through the outlet and the nozzles can deliver a spray of water through the nozzles.

7. The bathing fixture as defined in claim 6, wherein the pump is operatively connected to the water outlet nozzles and in operation bathing water is directed to recirculate to the outlet nozzles.

8. The bathing fixture as defined in claim 6, wherein the pump is operatively connected to the spout outlet, the water outlet nozzles and an outlet in the basin and in operation bathing water is recirculated to the spout outlet, the water outlet nozzles and the outlet in the basin either individually or simultaneously or in combination.

9. A bathing fixture wherein water is recirculated to a spout, comprising:

a lower basin for collecting water, said basin including a basin wall;

a conduit connected to and extending from the lower basin;

a waterfall spout in fluid communication with the lower basin via the conduit, said spout having an outlet mounted above the basin and including a ledge member extending essentially in a horizontal manner to direct the water in an essentially horizontal manner with respect to the lower basin and said spout in the form of a sheet of water, the ledge member including an upwardly open undulating upper surface extending from a front edge to a rear thereof;

a plurality of water outlet spray nozzles operatively connected to said conduit, said outlet nozzles positioned between the basin and the spout outlet and above the basin wall the nozzles delivering a spray of water through the nozzles;

a pump forming a part of the conduit for recirculating water that has collected in the basin to the spout in one instance and to the outlet nozzle in another instance; and an accumulator including a cavity positioned at an inlet of the spout, said pump also being connected to the spout via the conduit with the conduit outlet positioned in a vertical manner in the accumulator and the accumulator having a baffle structure constructed and arranged to effect a first and a second ninety degree turn in the flow of water from the outlet to the spout to effect an essentially uniform rate of water flow out of the spout, the ledge member being a separate component from the accumulator and connected thereto, the spout being upwardly open over a majority of the ledge portion of said undulating upper surface.

* * * * *

UNITED STATES PATENT AND TRADEMARK OFFICE

CERTIFICATE OF CORRECTION

Patent No. : 5,608,927

Dated : March 11, 1997

Inventor(s) : Scott R. Lowry et al.

It is certified that error appears in the above-identified patent and that said Letters Patent is hereby corrected as shown below:

Column 3, line 1, after "23" cancel "maybe" and substitute --may be--.

Claim 1, line 30

Column 4, line 52, before "outlet" cancel "wager" and substitute --water--.

Signed and Sealed this

Eighth Day of July, 1997

Bruce Lehman

*Attest:*

BRUCE LEHMAN

*Attesting Officer*

*Commissioner of Patents and Trademarks*